US007222379B2

(12) United States Patent
DiGirolamo

(10) Patent No.: US 7,222,379 B2
(45) Date of Patent: May 29, 2007

(54) PILLOW KIT WITH REMOVABLE INTERIOR CORES

(75) Inventor: Shelley A. DiGirolamo, Bellevue, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 10/810,150

(22) Filed: Mar. 26, 2004

(65) Prior Publication Data

US 2005/0210590 A1 Sep. 29, 2005

(51) Int. Cl.
*A47G 9/10* (2006.01)

(52) U.S. Cl. ..... 5/636; 5/645; 5/640

(58) Field of Classification Search ..... 5/645, 5/640, 639, 636, 737, 738, 722, 644, 950
See application file for complete search history.

(56) References Cited

U.S. PATENT DOCUMENTS

| | | | | | |
|---|---|---|---|---|---|
| 123,628 | A | * | 2/1872 | Haley | 5/696 |
| 655,087 | A | * | 7/1900 | Jones | 5/644 |
| 853,049 | A | * | 5/1907 | Weston | 5/738 |
| 1,206,775 | A | * | 11/1916 | Everts | 5/645 |
| 1,385,355 | A | * | 7/1921 | Banks | 5/636 |
| 2,500,974 | A | * | 3/1950 | Angert | 5/645 |
| 2,589,303 | A | * | 3/1952 | Sourbeck | 5/645 |
| 2,761,493 | A | * | 9/1956 | Lenz | 267/145 |
| 2,944,266 | A | * | 7/1960 | Wertheimer | 5/645 |
| 3,109,182 | A | * | 11/1963 | Doak | 5/636 |
| 3,148,389 | A | * | 9/1964 | Lustig | 5/645 |
| 3,283,346 | A | * | 11/1966 | Marsh et al. | 428/101 |
| 3,327,333 | A | * | 6/1967 | Jessup | 297/461 |
| 3,335,435 | A | * | 8/1967 | Marsh et al. | 5/652 |
| 3,403,414 | A | * | 10/1968 | Unger | 5/636 |
| 3,411,164 | A | * | 11/1968 | Sumergrade | 5/644 |
| 3,443,267 | A | * | 5/1969 | Schuckman | 5/645 |
| 3,766,577 | A | * | 10/1973 | Stewart | 5/12.1 |
| 3,840,918 | A | * | 10/1974 | Shave | 5/640 |
| 4,080,675 | A | * | 3/1978 | Kanowsky et al. | 297/452.58 |
| 4,164,797 | A | * | 8/1979 | Golembeck | 5/738 |
| 4,207,636 | A | * | 6/1980 | Ceriani | 428/101 |
| 4,606,088 | A | * | 8/1986 | Michaelsen et al. | 5/636 |
| 4,607,402 | A | | 8/1986 | Pollard | 5/425 |
| 4,754,513 | A | | 7/1988 | Rinz | 5/490 |
| 4,756,035 | A | * | 7/1988 | Beier | 5/640 |
| 4,768,248 | A | * | 9/1988 | O'Sullivan | 5/640 |
| 4,780,921 | A | | 11/1988 | Lahn et al. | 5/437 |

(Continued)

FOREIGN PATENT DOCUMENTS

| | | |
|---|---|---|
| GB | 2045604 | 11/1980 |

*Primary Examiner*—Robert G. Santos
(74) *Attorney, Agent, or Firm*—Jensen & Puntigam P.S.

(57) ABSTRACT

The pillow kit cover member, which includes substantially identical top and bottom portions, each of which includes inner and outer layers. The top and bottom portions are secured around the peripheries thereof, except for one side, which includes a zipper or similar element for opening and closing the pillow. The pillow includes an interior chamber assembly, which comprises baffle members which extend between the inner layers of the top and bottom portions, defining individual chambers which extend the length of the pillow. Filling is provided within the pillow chamber, as well as a plurality of inserts, having various fillings, which are selectively insertable into and removable from the pillow chambers. Different combinations of inserts vary the support characteristics of the pillow.

8 Claims, 1 Drawing Sheet

U.S. PATENT DOCUMENTS 4,799,275 A * 1/1989 Sprague, Jr. ..... 5/652
4,916,765 A 4/1990 Castronovo, Jr. ..... 5/437
4,930,173 A * 6/1990 Woller ..... 297/452.48
4,949,411 A 8/1990 Tesch ..... 5/434
4,959,880 A 10/1990 Tesch ..... 5/434
5,007,123 A * 4/1991 Salyards ..... 5/699
5,038,432 A * 8/1991 Robillard et al. ..... 5/645
5,168,590 A 12/1992 O'Sullivan ..... 5/490
5,344,437 A * 9/1994 Pistay ..... 607/109
5,459,894 A * 10/1995 Buonocore ..... 5/737
5,471,691 A * 12/1995 Ryndak ..... 5/645
5,636,397 A * 6/1997 Boyd et al. ..... 5/739
5,661,862 A * 9/1997 Ryndak ..... 5/636
5,809,594 A * 9/1998 Isogai ..... 5/645
5,819,347 A * 10/1998 Masuda ..... 5/641
5,953,777 A 9/1999 Buck ..... 5/636
6,151,733 A 11/2000 Takashima ..... 5/636
6,189,168 B1 * 2/2001 Graebe ..... 5/644
6,363,557 B2 * 4/2002 Chou ..... 5/645
6,415,466 B1 7/2002 Laiso ..... 5/485
6,594,838 B1 * 7/2003 Hollander et al. ..... 5/636
6,671,906 B1 * 1/2004 Milligan ..... 5/636
6,691,352 B2 * 2/2004 Wang ..... 5/636
6,910,237 B2 * 6/2005 DiGirolamo ..... 5/636
6,928,677 B1 * 8/2005 Pittman ..... 5/636
D523,678 S * 6/2006 Ferber et al. ..... D6/601
7,080,421 B1 * 7/2006 Delfs ..... 5/645
7,120,953 B2 * 10/2006 Ferber et al. ..... 5/636
2002/0138908 A1 * 10/2002 Wang ..... 5/636
2005/0210590 A1 * 9/2005 DiGirolamo ..... 5/636
2006/0075562 A1 * 4/2006 DiGirolamo ..... 5/645
2006/0236460 A1 * 10/2006 Hooper ..... 5/636

* cited by examiner

FIG. 1
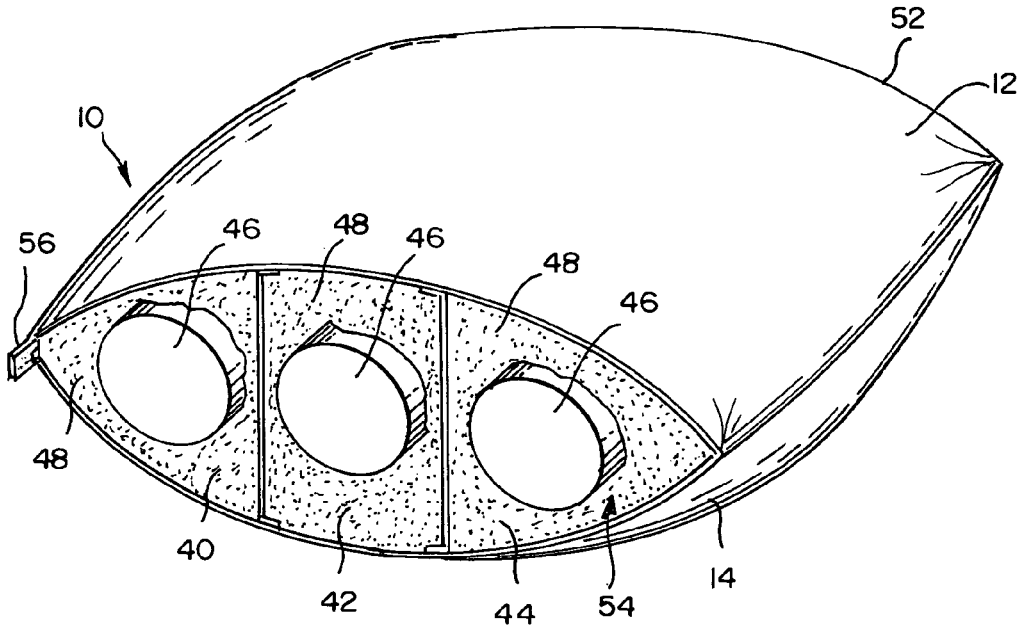
FIG. 2
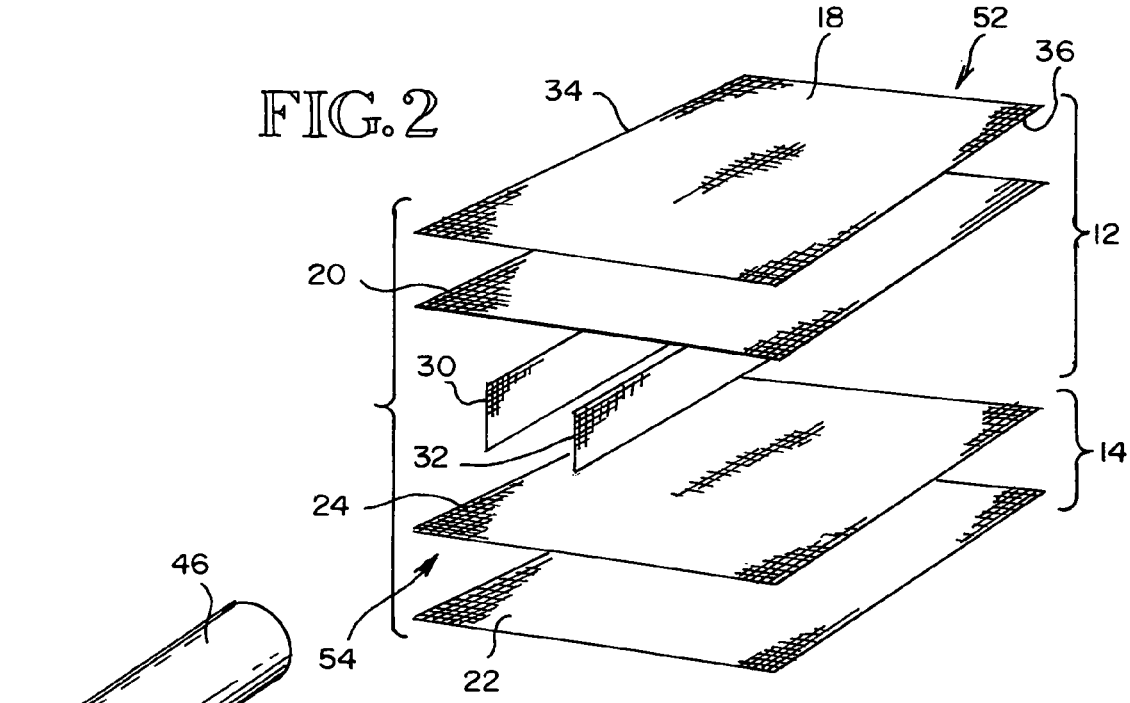
FIG. 3

PILLOW KIT WITH REMOVABLE INTERIOR CORES

TECHNICAL FIELD

This invention relates generally to the field of pillow construction, and more specifically concerns a pillow having interior chambers.

BACKGROUND OF THE INVENTION

Generally, pillows have a "permanent" construction, i.e. most pillows are not configured or arranged to accommodate a change in fill or interior arrangement after manufacture. Such pillows thus have a fixed support characteristic, from soft to firm, although in some cases, they have other support features or characteristics which are intended to address particular concerns or desires of various users.

However, there are some pillows which have a construction which permits change in support. One such pillow, shown in U.S. Pat. No. 6,415,466 to Laiso, includes pockets on the outside of the pillow to receive different inserts which change to an extent the support characteristics of the pillow. There are also other pillows, such as shown in U.S. Pat. No. 5,953,777 to Buck, which show pillow inserts which change the pillow characteristics. Those pillows, however, do not provide a reliable, convenient "adjustable" support capability. It would be desirable to have a pillow which is capable of being adjusted with different inserts or filling to provide different support characteristics.

SUMMARY OF THE INVENTION

Accordingly, the present invention is a pillow kit, comprising: a cover assembly which includes substantially identical top and bottom portions, the top and bottom portions including spaced longitudinal sides and end sides, wherein the top and bottom portions are secured around the peripheries thereof except for one side, means for selectively opening and closing said one side; at least one chamber section located interiorly of the cover assembly; filling located interiorly of the cover assembly; and at least one core member, constructed to be insertable into and removable from the chamber section, for selectively changing the support characteristics of the pillow.

BRIEF DESCRIPTION OF THE DRAWINGS

FIG. 1 shows a perspective view of the assembled pillow kit of the present invention, from one end thereof.

FIG. 2 shows an exploded view of the pillow of FIG. 1.

FIG. 3 shows a perspective view of an insert member of the pillow kit of the present invention.

BEST MODE FOR CARRYING OUT THE INVENTION

FIGS. 1, 2 and 3 show the pillow kit of the present invention, providing an adjustable support capability. Pillow kit 10 includes identical top and bottom layer assemblies 12 and 14, the top layer assembly including an outer layer portion 18 and an inner layer portion 20. The bottom layer assembly includes an outer layer portion 22 and an inner layer portion 24. In this embodiment, inner layer portions 20 and 24 are polyester material or similar slick fabric, while outer layer portions 18 and 22 are cotton. This could, however, be changed to other materials, although a slick fabric for the inner layer portions is generally advantageous.

Extending between inner layer portions 20 and 24 are two baffle walls 30 and 32, defining three internal chambers, which, in the embodiment shown, extend for the full length of the pillow, although the baffle walls can, alternatively, extend for less than the full length of the pillow, if so desired.

In the embodiment shown, baffle walls 30, 32 are identical, are approximately 5 inches high, and are made from polyester or other slick material, although they could be cotton or other fabric as well. For a pillow 20 inches wide and 26 inches long, as shown, baffle walls 30, 32 are positioned 6.75 inches from the longitudinal edges 34, 36 of the pillow, leaving a separation of 6.5 inches between the two baffle walls. This spacing, however, can be altered to define different size chambers.

In the embodiment shown, the two baffle walls 30, 32 define chambers 40, 42 and 44. The chambers are adapted to receive core inserts 46 shown in FIG. 3. Filling material, such as natural fill (feathers and down) 48 or polyester foam fill material, is inserted in the chambers 42, 44 and 46 along with the inserts 46, between the inserts and the inner layers 20 and 24 and the baffle walls 30 and 32. Fill can be also positioned between the outer and inner layer portions of the top and/or bottom layer assemblies. In some cases, fill will be positioned only between the outer and inner layer portions and not in one or more of the chambers.

To complete the pillow, the top and bottom layer assemblies 12 and 14 are secured around their longitudinal edges 34, 36 and one end 52, with the remaining end 54 being closable and openable by a closing member 56, which when open reveals the interior chambers 40, 42 and 44. Appropriate core inserts 46 may be inserted and removed, depending upon the desires of the user.

The number of chambers can be varied, as well as their respective sizes, by varying the number and location of the baffle members. Each chamber is adapted to receive a core insert 46, shown in FIG. 3. In the embodiment shown, the core insert 46 is an elongated soft cylinder, approximately 3-5 inches in diameter, 26 inches long and includes a cover 62 which may be filled with various filling materials, including polyester or natural fillings, such as feathers, down or foam. Furthermore, the pillow kit can include a plurality of such inserts, with various fillings, to enable a change in the support characteristics of the pillow. The inserts may also have various fill weights, i.e. various densities and may vary in size. The core inserts 46 are typically configured to fill a significant portion of their receiving chamber volumes, while being easy to insert and remove.

As indicated above, the top and bottom layer assemblies 12 and 14 are secured together, such as by stitching along the two longitudinal edges 34 and 36 and one end 52. The other end 54 has a closing member 56, such as a zipper, or Velcro® members, or similar member. In use, closing member 56 is first opened, revealing an open end of the receiving chambers. One or more core inserts are then positioned in one or more (typically all) of the chambers to provide a desired support characteristic. The closing member 56 is then closed, resulting in a pillow having a particular support characteristic. A significant advantage of the disclosed structure is that the support characteristic of the pillow can be changed by removing an existing core insert and replacing it with another with a different characteristic, e.g. a different size or kind of fill or fill weight. Further, one or more of the receiving chambers can remain without an insert, with just filling 48 in the chamber.

Accordingly, a pillow kit has been disclosed which provides an adjustable support capability. This is accomplished by a pillow with a plurality of interior chambers, which are accessible for insertion and removal of core inserts, each of which typically includes a core cover and interior filling.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A pillow kit, comprising:

a cover assembly for a stand-alone pillow which includes substantially identical top and bottom portions, the top and bottom portions including spaced longitudinal sides and end sides, wherein the top and bottom portions are secured around the peripheries thereof except for one side;

means for selectively opening and closing said one side;

a plurality of chamber sections located interiorly of the cover assembly, defining a plurality of volumes which do not communicate with one another within the cover assembly for the pillow;

loose filling located within the plurality of chamber sections; and a plurality of core members, constructed to be insertable into and removable from the plurality of chamber sections, for selectively changing the support characteristics of the pillow.

2. The pillow kit of claim 1, wherein the chamber sections extend for substantially the entire length of the pillow.

3. The pillow kit of claim 1, wherein the inserts have different support characteristics.

4. The pillow kit of claim 3, wherein the different characteristics include differences in fill weight.

5. The pillow kit of claim 1, wherein the top and bottom portions each have an outer layer of cotton and an inner layer of polyester and wherein the chamber sections are defined by polyester baffle members which extend between the inner layers of the top and bottom portions.

6. The pillow kit of claim 1, wherein the pillow filling is natural feathers and/or down.

7. The pillow kit of claim 1, wherein the pillow filling is synthetic material.

8. The pillow kit of claim 1, wherein the top and bottom portions each comprise substantially identical outer and inner layers, and further including loose filling located between the outer and inner layers of the top and bottom portions.

* * * * *